US005373591A

United States Patent [19]

Myers

[11] Patent Number: 5,373,591

[45] Date of Patent: Dec. 20, 1994

[54] SHOWER-COMMODE CHAIR AND TRANSFER TRACK

[75] Inventor: Rick L. Myers, Conroe, Tex.

[73] Assignee: Sari H. Gill, Houston, Tex. ; a part interest

[21] Appl. No.: 939,931

[22] Filed: Sep. 2, 1992

[51] Int. Cl.[5] ..... A47K 3/12

[52] U.S. Cl. ..... 4/560.1; 4/578.1

[58] Field of Search ..... 4/254, 480, 560.1, 578.1, 4/579, 667

[56] References Cited

U.S. PATENT DOCUMENTS

| | | | |
|---|---|---|---|
| 3,703,733 | 11/1972 | McLoughlin | 4/560.1 X |
| 3,758,894 | 9/1973 | Finley | 4/560.1 X |
| 4,168,549 | 9/1979 | Davies | 4/578.1 |
| 4,253,203 | 3/1981 | Thomas | 4/560.1 X |
| 4,266,305 | 5/1981 | Kavaloski et al. | 4/254 X |

FOREIGN PATENT DOCUMENTS

| | | | |
|---|---|---|---|
| 1586660 | 3/1981 | United Kingdom | 4/578.1 |

*Primary Examiner*—Charles E. Phillips
*Attorney, Agent, or Firm*—Kenneth A. Roddy

[57] ABSTRACT

A shower-commode chair and bathtub transfer track can be connected together to transfer a person on a sliding chair seat between the chair and the tub area of a bathtub in a seated position without being lifted from the seat. The chair has an adjustable height frame supported on wheels and a pair of horizontal channels secured in parallel spaced relation extending from side to side. A seat is supported on rollers in the horizontal channels. The bathtub transfer track has a pair of elongate channels secured in parallel spaced relation to extend transversly from one side of the bathtub to the other on the top surfaces of the bathtub walls and span the open area of the bathtub to receive and support the seat. Removable arm members on the chair frame retain the seat on the chair frame when attached and allow movement of the seat when removed. A removable backrest connected to the seat moves with the seat. The transfer track is adjustable to correspond with the chair height, adjustable angularly relative to a horizontal plane to facilitate drainage, and adjustable to fit bathtubs of various widths. The chair may be used alone as a commode chair, and the track with the seat supported thereon may be used independently of the chair. Optional wheel, seat, and frame arrangements convert the chair either to an occupant propelled multi-purpose chair capable of passing through a standard bathroom doorway or, to an occupant propelled wheelchair.

9 Claims, 9 Drawing Sheets

B
17
16
35
18
36
34
33
29
73
66
18
56
52
51
56
60,63
51
50
53
66
64
77
67,69
74
20
13
15A
22A
21
15
14
12
16
34
17
33
27
26
18
11
22B
13
15A
24
15
19,20
13
14
15
21
15
14
12
10
28
77
73
23
19
12
15A
12

B
36
34
51
56
52
35
29
33
26
56
34
33
28
66
16
17
23
53
84
24
27
50
51
60,63
66
64
67,69
77
18
11
24
13
22B
21
77
13
10
15A
18
23
15A
15
12
19,20
15
14
13
15A
21
14
15
21
12
12
15
14
12

10
11
13
19
22A
22B
23
24
25
26
27
28
29
30
31
32
33
34
37
38
39A

SHOWER-COMMODE CHAIR AND TRANSFER TRACK

BACKGROUND OF THE INVENTION

1. Field of the Invention

This invention relates generally to shower chairs, commode chairs, and wheelchairs of the type accommodating non-ambulatory persons, and more particularly to a combination shower-commode chair and transfer track wherein the chair has a seat which is slidable from the chair onto a track mounted on a bathtub which allows a person to be transported to the bathroom and then rolled on the chair seat over an area above the bathtub without requiring the person to be lifted from the seat. Optional wheel, frame, and seat arrangements allow conversion to a multi-purpose chair propelled by the occupant or to a wheelchair.

2. Brief Description of the Prior Art

Non-ambulatory persons which include paraplegics (those without the use of their lower extremities) face numerous problems in carrying out activities of daily living (ADL), such as dressing, toileting, and showering or bathing. One of the major problems is merely gaining entry into a conventional bathroom, because of the standard narrow doorway, and once inside, gaining access to the conventional commode and bathtub or shower facilities.

Many non-ambulatory persons must be lifted from a wheelchair to a bed where they can be most easily undressed and then lifted by an attendant and placed into the wheelchair and transported to the bathroom doorway, which is usually too narrow to allow passage of the wheelchair. The non-ambulatory person is then lifted from the wheelchair, carried through the narrow doorway, and then placed onto the commode seat for toileting or on a chair which has been previously placed in the bathtub or shower stall for a bath or shower.

This repeated lifting subjects both the non-ambulatory person and the attendant to possible physical strain or injury and is particularly hazardous because of the risk of slipping or falling. Disabled persons desire to accomplish their daily bathroom activities in privacy and without any more handling by an attendant than is absolutely necessary. Being physically handled while undressed can be very degrading to the disabled.

Often, when there is no attendant available, or to avoid physical handling and being carried nude, those non-ambulatory persons who are physically able will lower themselves from their bed or wheelchair in their bedroom and crawl through the standard doorway which is too narrow for wheelchair passage. Once inside the bathroom, they must undress themselves and then pull themselves into the commode seat or a shower seat which has been placed into a bathtub on shower stall.

Commode chairs are known in the art, for non-ambulatory persons who do not have sufficient upper arm strength to pull themselves onto the commode seat or shower chair previously placed in the tub or shower stall. These commode chairs have a seat with a central aperture which is fixedly mounted on a wheeled frame which allows a person to be placed in the chair and then moved over the commode. Since the seat portion is fixed to the frame, the common commode chair is limited in use. Even though a non-ambulatory person may be lifted onto the commode chair, he or she must be lifted again to be placed into a chair in the bathtub or shower stall.

Widening standard bathroom doorways is expensive and may not be architecturally possible because of structural or space limitations, leasing restrictions, etc. There are no known commode chairs capable of occupant propulsion through a standard narrow bathroom doorway from any site outside the bathroom where undressing is most easily accomplished.

There are several patents which disclose various chair and track arrangements which facilitate the use of bathroom facilities.

Thomas, U.S. Pat. Nos. 4,253,203 and 4,359,791 disclose a collapsible bench which cooperates with a roller mounted rotatable chair so that a person can slide into and out of the bathtub area. The Thomas transfer bench has two legs supported in the bathtub and two legs supported on the floor adjacent the bathtub. The Thomas apparatus requires that non-ambulatory person be lifted onto the shower seat which has been previously placed in the tub. It cannot be used as commode chair cannot transport an occupant through a doorway, cannot be propelled by the occupant, or be converted to a wheelchair.

Bailey, U.S. Pat. No. 4,150,445 discloses a shower chair assembly having a track movably mounted on the tub which cooperates with a rotatable chair so that a person can slide longitudinally and rotate in the bathtub area. The track is movably mounted on rollers and moved relative to the bathtub. The Bailey assembly requires that the non-ambulatory person be lifted onto the rotatable seat. It cannot be used as commode chair, cannot transport an occupant through a doorway, and cannot be propelled by the occupant, or be converted to a wheelchair. It is also not collapsible and easily portable.

Hancock, U.S. Pat. No. 4,091,479 discloses a shower chair assembly having a track frame with wheels on the bottom such that it can be placed partially in and partially out of a shower stall or bathtub and has a chair seat on the frame which allows a person to slide into the shower stall or bathtub area and rotate. The track is movably mounted on rollers and moved relative to the shower stall or bathtub. The assembly requires that the non-ambulatory person be lifted onto the rotatable seat. It cannot be used as commode chair, cannot transport an occupant through a doorway, cannot be propelled by the occupant, or be converted to a wheelchair. It is also not collapsible and easily portable.

Maling, U.S. Pat. No. 3,090,969 discloses a traveling chair for shower stalls which includes a frame supported on the floor partially in and partially out of a shower stall and has a chair seat on the frame which allows a person to slide into the shower stall. The assembly requires that the non-ambulatory person be lifted onto the rotatable seat. It cannot be used as commode chair, cannot transport an occupant through a doorway, cannot be propelled by the occupant, or be converted to a wheelchair. It is also not collapsible and easily portable.

McLoughlin, U.S. Pat. No. 3,703,733 discloses a bath and chair arrangement which includes a custom made tub having a door. Although the chair has a track, there is no suggestion of a track which can be mounted on an existing conventional tub which cooperates with the chair. The assembly requires a special tub which would be expensive. It cannot be propelled by the occupant in the manner of a wheelchair, is not portable, and is not designed for conventional tubs.

The present invention is distinguished over the prior art in general, and these patents in particular by a shower-commode chair and bathtub transfer track which can be easily mounted on a conventional tub and connected together to transfer a person on a sliding chair seat between the chair and the tub area of a bathtub in a seated position without being lifted from the seat. The chair has an adjustable height frame supported on wheels and a pair of horizontal channels secured in parallel spaced relation extending from side to side. The seat is supported on rollers slidably received in the horizontal channels. The bathtub transfer track has a pair of elongate channels secured in parallel spaced relation to extend transversly from one side of the bathtub to the other supported on the top surfaces of the bathtub walls and spanning the open tub area of the bathtub to receive and support the seat. Independently removable arm members connected to the chair frame retain the seat on the chair frame when attached and allow movement of the seat when removed. A removable backrest connected to the seat moves with the seat and a seatbelt may be connected to the backrest. The transfer track is adjustable in height to correspond with the chair height, adjustable angularly relative to a horizontal plane to facilitate drainage, and adjustable to fit bathtubs of various widths. The chair may be used alone as a commode chair or in combination with the track, and the track with the seat supported thereon may be used independently of the chair. Optional wheel, seat, and frame arrangements convert the chair either to an occupant propelled multi-purpose chair capable of passing through a standard bathroom doorway or, to an occupant propelled wheelchair.

SUMMARY OF THE INVENTION

It is therefore an object of the present invention to provide a multi-purpose chair for the handicapped which can function as a shower chair, commode chair, and/or conventional wheelchair and eliminates the need to purchase a separate shower chair, commode chair, and wheelchair.

It is another object of this invention to provide a shower-commode chair and a cooperative transfer track installed on a bathtub which allows a non-ambulatory person to be safely and easily transferred from a bed, another chair, or wheelchair to the shower-commode chair and then transported to an area over the bathtub for bathing or showering.

Another object of this invention is to provide a shower-commode chair having a rolling seat which can be easily and safely rolled off the chair frame and onto a transfer track installed on a bathtub.

Another object of this invention is to provide a transfer track which can be easily and quickly installed on a bathtub and which has a rolling seat to allow persons to safely enter and exit a bathtub.

Another object of this invention is to provide a shower-commode chair which is adjustable in height and can be wheeled into a bathroom and positioned to place the chair seat above the toilet bowl.

Another object of this invention is to provide a shower-commode chair and bathtub transfer track which are both adjustable in height and can be precisely aligned to transfer a person from the chair to the bathtub in a seated position.

Another object of this invention is to provide a shower-commode chair having wheel, seat, and frame arrangements which allow it to be converted to a multipurpose chair capable of being propelled by the occupant from a convenient undressing area through a standard bathroom doorway for toileting or showering.

Another object of this invention is to provide a shower-commode chair for handicapped persons having a pair of propulsion wheels which can be raised and lowered whereby the chair is selectively supported either on four wheels in the manner of a shower or commode chair, or on the propulsion wheels and two smaller wheels to be propelled and maneuvered by the occupant in the manner of a conventional wheelchair through a standard bathroom doorway.

Another object of this invention is to provide a shower-commode chair having wheel, seat, and frame arrangements which allow it to be converted to a wheelchair capable of being propelled by the occupant.

A further object of this invention is to provide a shower-commode chair which is lightweight, portable, and can be collapsed and stored in a small space.

A still further object of this invention is to provide a shower-commode chair and transfer track which is simple in construction, comfortable for the occupant, easy and safe to use, economical to manufacture, and rugged and durable in use.

Other objects of the invention will become apparent from time to time throughout the specification and claims as hereinafter related.

The above noted objects and other objects of the invention are accomplished by a shower-commode chair and bathtub transfer track which can be connected together to transfer a person on a sliding chair seat between the chair and the tub area of a bathtub in a seated position without being lifted from the seat. The chair has an adjustable height frame supported on wheels and a pair of horizontal channels secured in parallel spaced relation extending from side to side. The seat is supported on rollers slidably received in the horizontal channels. The bathtub transfer track has a pair of elongate channels secured in parallel spaced relation to extend transversly from one side of the bathtub to the other supported on the top surfaces of the bathtub walls and spanning the open tub area of the bathtub to receive and support the seat. Independently removable arm members connected to the chair frame retain the seat on the chair frame when attached and allow movement of the seat when removed. A removable backrest connected to the seat moves with the seat and a seatbelt may be connected to the backrest. The transfer track is adjustable in height to correspond with the chair height, adjustable angularly relative to a horizontal plane to facilitate drainage and adjustable to fit bathtubs of various widths. The chair may be used alone as a commode chair or in combination with the track, and the track with the seat supported thereon may be used independently of the chair. Optional wheel, seat, and frame arrangements convert the chair to an occupant propelled multipurpose chair capable of passing through a standard bathroom doorway or to an occupant propelled wheelchair.

DESCRIPTION OF THE PREFERRED EMBODIMENT

Figure 1:
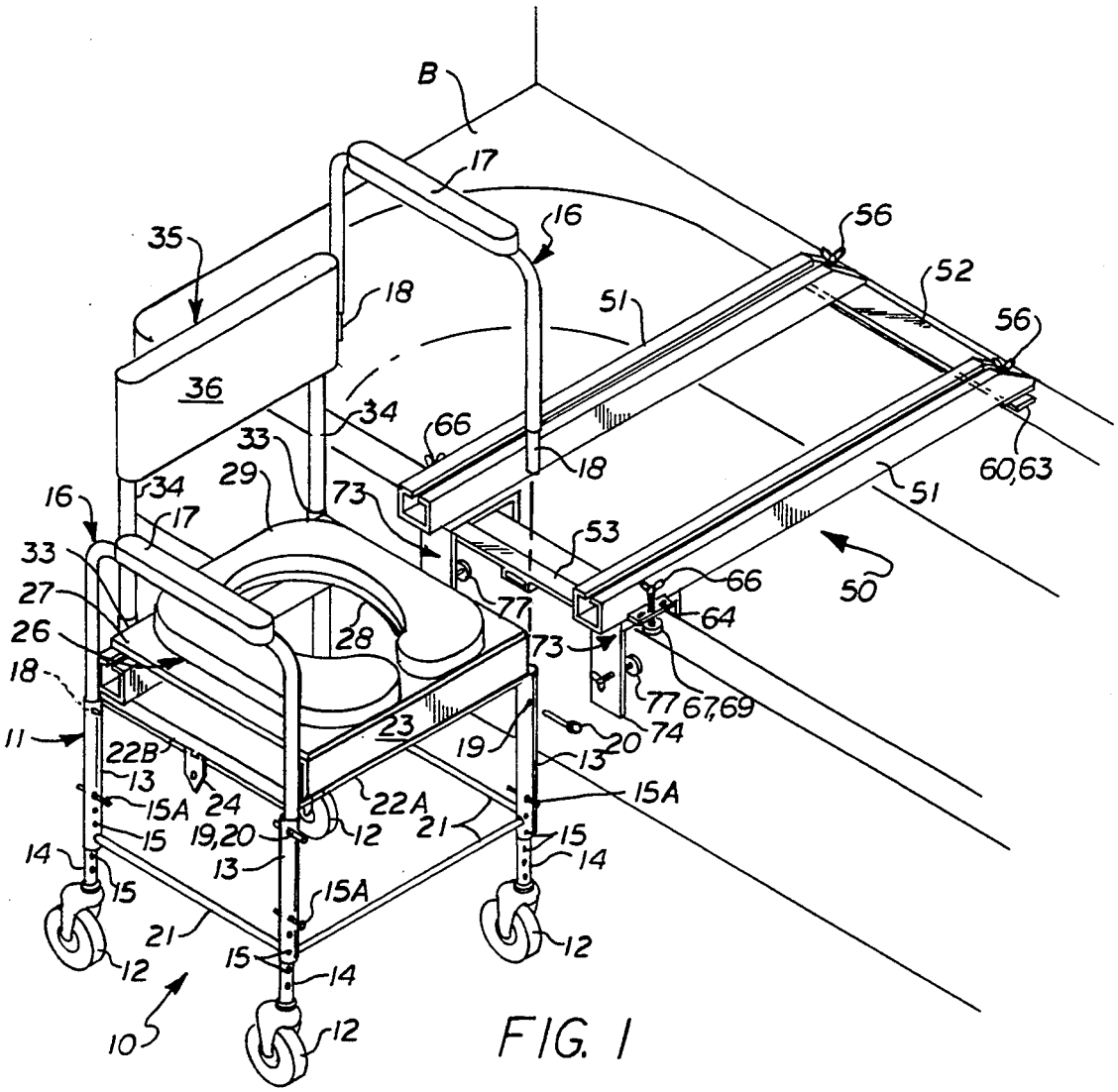
FIG. 1 is an isometric view of the shower-commode chair and transfer track in accordance with the present invention showing the shower-commode chair prior to rolling the seat onto the transfer track.
Figure 2:
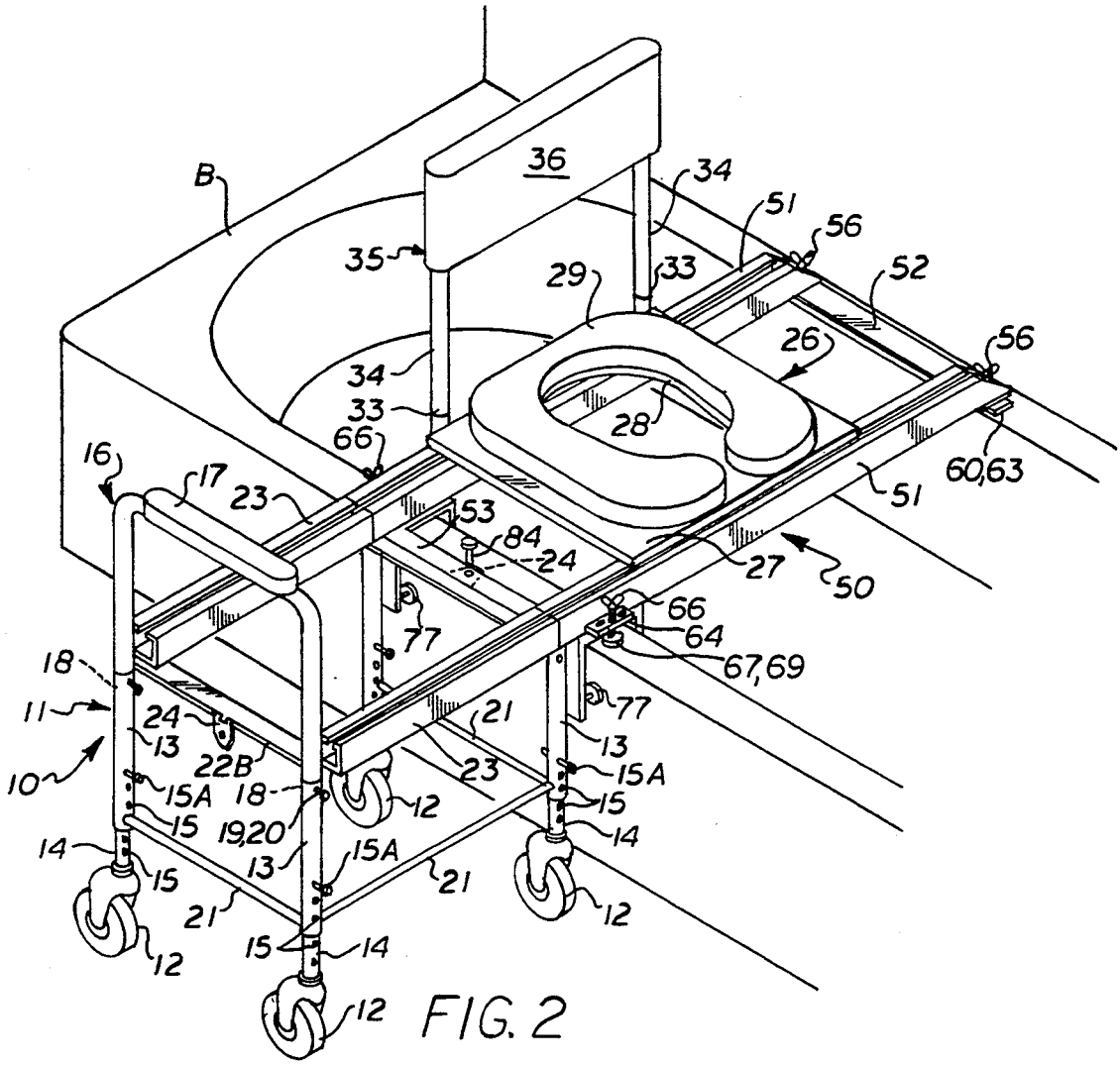
FIG. 2 is an isometric view of the shower-commode chair showing the seat of the shower-commode chair supported above a bathtub on the transfer track.
Figure 3:
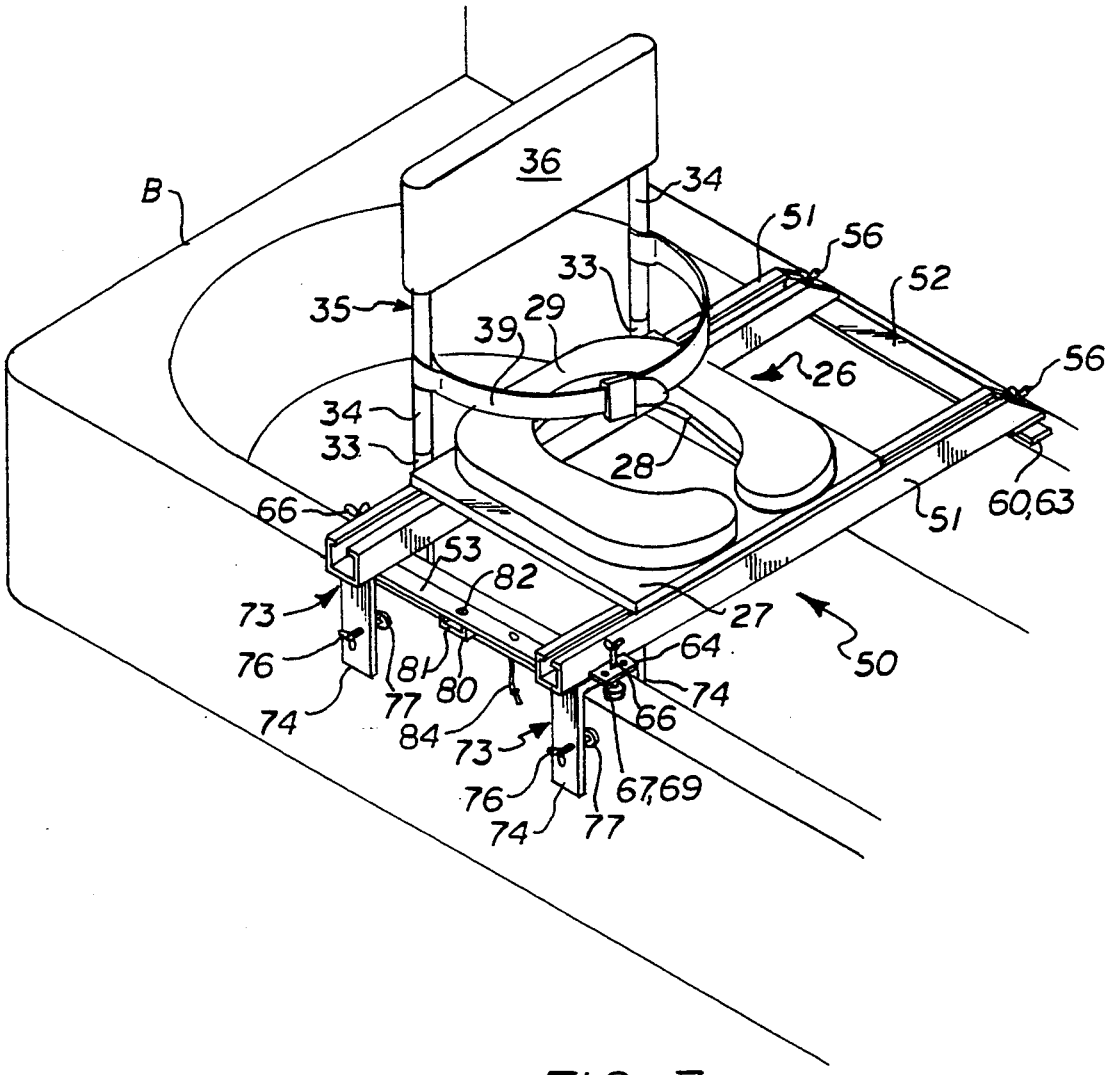
FIG. 3 is an isometric view of the shower-commode chair showing the seat of the shower-commode chair supported above a bathtub on the transfer track and the shower-commode chair removed.

Referring to the drawings by numerals of reference, there is shown in FIG. 1, a preferred shower-commode chair 10 and transfer track 50. The transfer track 50 is mounted on the bathtub B and the commode chair 10 is shown adjacent the track prior to rolling the seat 26 onto the transfer track as described hereinafter. FIG. 2 shows the seat 26 of the shower-commode chair supported above the bathtub B on the transfer track 50, and FIG. 3 shows the seat of the shower-commode chair supported above a bathtub on the transfer track with the shower-commode chair removed.

Referring additionally to FIGS. 4 through 7, the shower-commode chair 10 has a tubular steel frame 11 supported on wheels 12. The shower-commode chair has four tubular legs 13 with an inner tubular member 14 telescopically received in the bottom ends on which the wheels 12 are mounted. Height adjustment holes 15 extend between the tubular members 13 and 14 and are selectively engaged by a locking push button or pin 15A in a conventional manner such that height adjustments can be obtained. Because the leg height of the chair is adjustable, it is possible to accommodate the chair to fit various toilet bowl heights, bathtub heights, and the height of other objects, such as a bed or wheelchair, to and from which the disabled user is transferred.

The upper end of the tubular legs 13 is open and slidably receives arm members 16. The arm members 16 are inverted U-shaped tubular members having arm pads 17 secured thereon. The lower ends of the arm members 16 have a reduced diameter portion 18 which is slidably and removably received in the open top end of the legs 13. Holes 19 extend through the upper end of the legs 13 and the tubular arm portions 18 and are engaged by a push button or removable pin 20 such that when the pins are removed, the arm 16 on either side of the chair frame may be removed by lifting it out of the leg 13.

Figures 4, 5, 6:
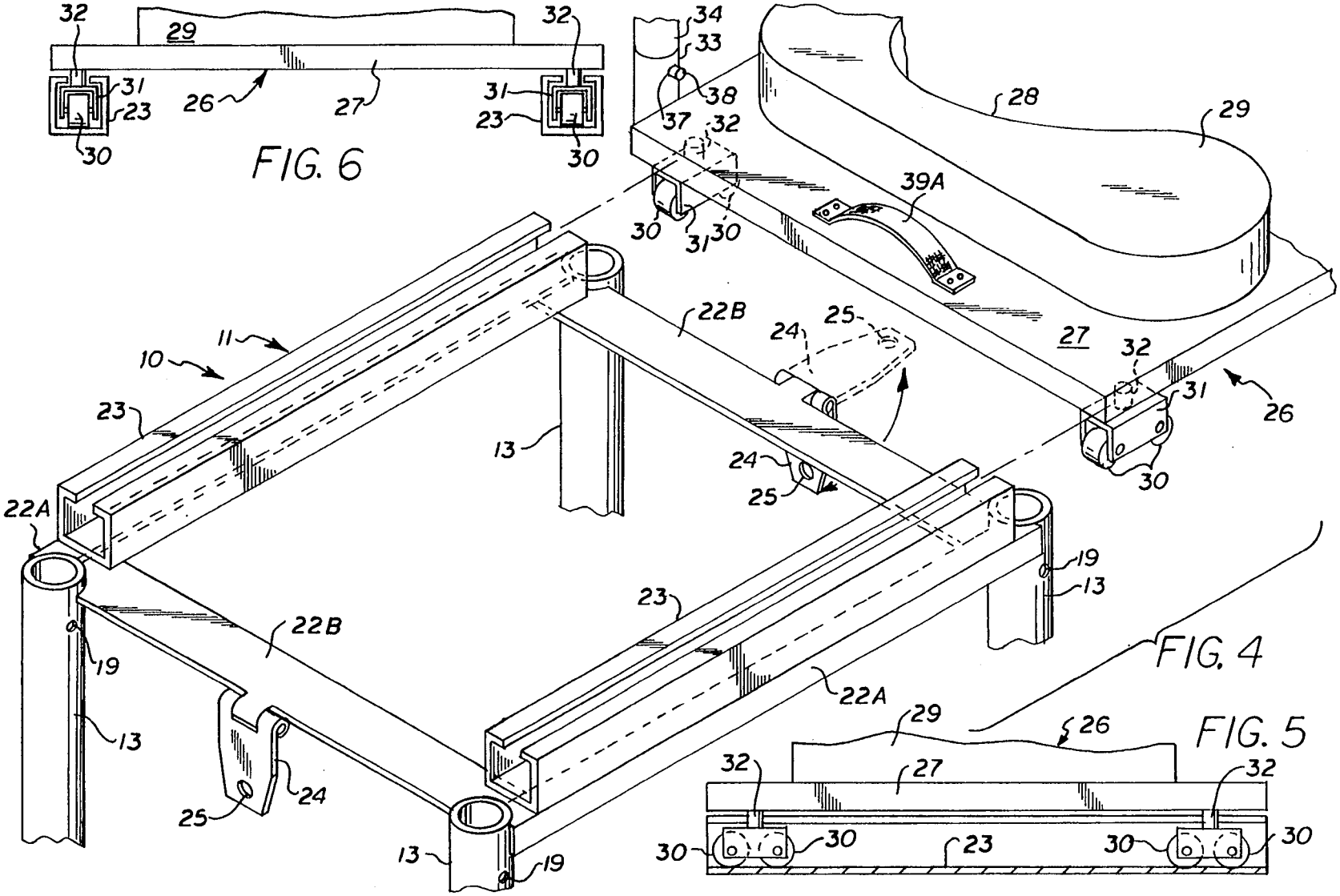
FIG. 4 is a partial isometric view of the upper portion of the shower-commode chair showing a portion of the seat of the shower-commode chair adjacent the support channels of the chair.
FIG. 5 is a longitudinal cross section through one of the support channels of the shower-commode chair with the seat rollers mounted therein.
FIG. 6 is a transverse cross section through the support channels of the shower-commode chair with the seat rollers mounted therein.
Figure 7:
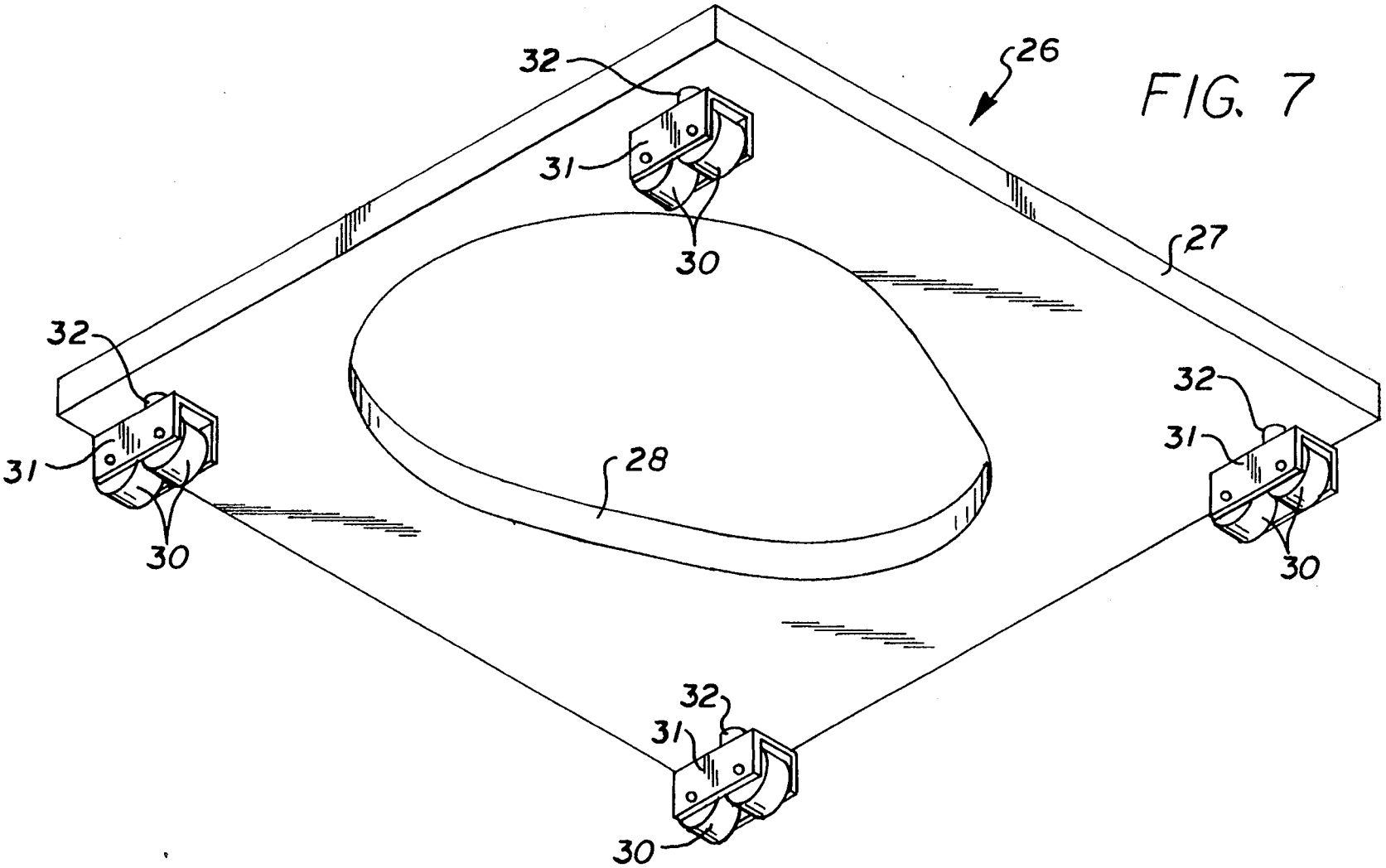
FIG. 7 is an isometric view showing the underside of the seat member of the shower-commode chair.

The chair has lower cross members 21 which extend between the lower portion of the legs 13 on the sides and front and, as best seen in FIG. 4, upper cross members 22A which extend from side to side between the top end of the legs, and upper cross members 22B which extend from front to rear between the top ends of the legs.

A pair of inverted C-shaped channel members 23 are secured on two opposed upper cross members 22A to extend transversly between the front and rear of the chair frame 11. The outer ends of the channel members 23 terminate adjacent the open top ends of the legs 13 such that when the arms 16 are connected into the legs, they serve as a stop surface at the ends of the channel members 23. Optionally, the tubular portions of the arms 16 may be dimensioned such that when the pin 20 is removed, they will drop down to position the arm pad 17 approximately even with the top of the channel members 23 to facilitate transfer onto the seat 26 of the chair from one side. A flat tapered connector member 24 having a hole 25 near its outer end is hinged to each of the other two opposed upper cross members 22B and pivot relative thereto.

A seat member 26 is slidably received in the channel members 23. The seat member 26 has a flat platform 27 with a central aperture 28 and the aperture is substantially surrounded by a seat cushion 29 formed of resilient material having a water resistant outer covering secured to the top surface of the platform. A set of rollers 30 rotatably mounted in brackets 31 are secured by spacers 32 to the underside of the platform 27 near each corner (FIGS. 4 and 6). The spacers 32 space the top end of the brackets 31 a short distance from the bottom surface of the platform 27 such that the spacers 32 are received in the slotted portion of the C-shaped channels 23 and the top surface of the channels will not contact the top of the brackets 31 or the underside of the platform 27 during movement of the seat 26 relative to the channels 23. This arrangement also prevents the seat member 26 from being vertically displaced from the channels 23. The preferred rollers 30 are formed of suitable waterproof material, such as plastic or hard rubber.

A pair of tubular members 33 (FIG. 4) are secured to the rear edge of the platform 27 near each corner which slidably receive the lower ends of the tubular frame members 34 of a backrest member 35. The backrest 35 has a cushion 36 formed of resilient material with a water resistant outer covering extending transversly between the tubular frame members 34. Holes 37 extend through the tubular members 33 and the lower end of backrest frame members 34 and are engaged by a removable pin or push button 38, such that the backrest 35 can be removed by lifting it out of the tubular members 33. The backrest 35 may also be adjustable in height. During use, the backrest 35 may be left in place and moves with the seat 26. As shown in FIG. 3, a seat belt 39 may be installed on the backrest 35 by which the non-ambulatory person can be secured in position on the seat, and as seen in FIG. 4, handle straps 39A may be installed on each side of the seat cushion 36.

It should be understood that the shower-commode chair may be used alone as a commode chair or in combination with the track 50 (described hereinafter). The chair can also be used by a semi-ambulatory person who may not desire or may not be physically able to walk into the bathroom. In use as a commode chair, one of the arm members 16 is removed and the semi or non-ambulatory person transfers from the bed, wheelchair, or other chair, to the chair 10 and the arm is replaced. The channels 23 may be provided with holes at the outer sides of the wheels through which pins can be inserted to prevent the seat from rolling off the track during the transfer. When the arm members 16 are in place, they prevent the seat 26 from rolling out of the channels 23. The chair can then be rolled into the bathroom and positioned with the legs 13 on each side of the commode to place the chair seat 26 above the toilet bowl. The shower-commode chair 10 may also be provided with a pair of rails or a platform beneath the seat 26 which would support a removable container or bed pan whereby it would not be necessary to transport the chair to the toilet. Conventional Pivotal footrests may also be removably installed on the front legs 13.

Figures 8, 9, 10:
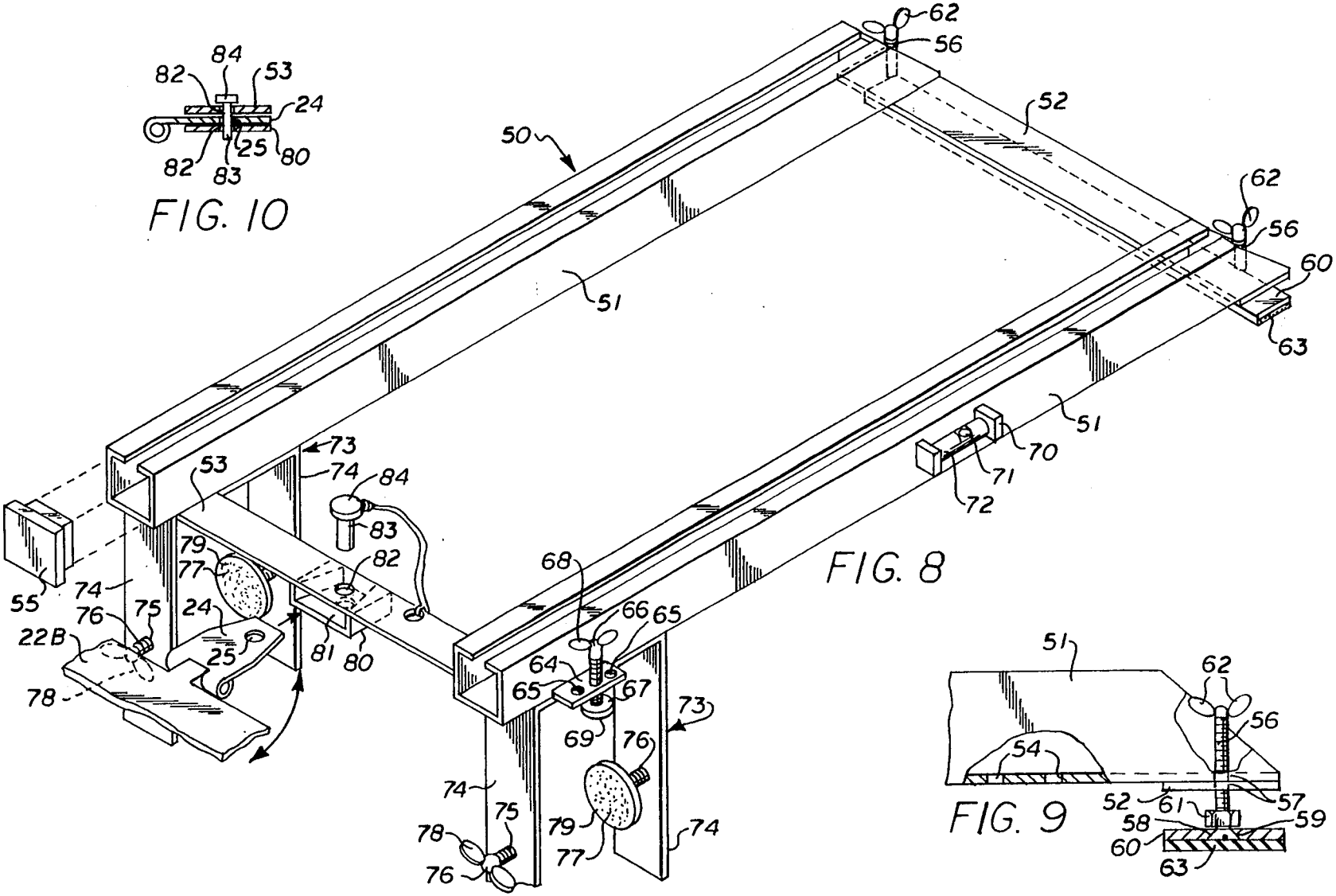
FIG. 8 is an isometric view of the transfer track for the shower-commode chair.
FIG. 9 is a cross sectional view of the support member of the transfer track at the tub wall end.
FIG. 10 is a cross sectional view of the coupling member between the shower-commode chair and the transfer track.

Referring now to FIGS. 1 through 3 and 8, 9, and 10, there is shown a transfer track 50 which is mounted on the bathtub to extend transversly across the open area of the tub. The transfer track 50 has a pair of elongate channel members 51 which are secured parallel to one another by flat rectangular cross members 52 and 53 at each end. The channel members 51 in cross section are C-shaped and substantially the same size as the channel members 23 of the chair 10. As best seen in FIG. 9, the bottom wall of the channel members may be provided with holes 54 to facilitate drainage.

Cross member 52 is disposed at the end of the channels 51 which fits on the bathtub at the wall side of the bathtub. The ends of the channel members where the cross member 52 is secured are angled. As best seen in FIGS. 8 and 9, a pair of threaded adjustment screws 56 are threadedly received in threaded holes 57 through the bottom wall of channels 51 and cross member 52 and have a flat headed end 58 which is rotatably received in an aperture 59 in a rectangular support strap member 60. A stop nut 61 is welded or otherwise secured on the shaft of each adjustment screw to maintain the support strap 60 rotatably on the headed ends of the adjustment screws 56. The top end of the adjustment screws 56 are provided with a knob or wings 62 for rotating the screws 56. A pad 63 of water resistant resilient material is secured to the bottom surface of the support strap 60 to prevent the tub wall from being marred by the structure.

The support strap 60 is supported on the top edge of the bathtub adjacent the wall against which the bathtub is installed. Rotation of the adjustment screws 56 causes relative vertical movement between the cross member 52 and the support strap 60 such that when the support strap is supported on the bathtub, the end of the track assembly may be raised or lowered.

A plate 64 is secured to the outer sides of each channel member 51 near the end of the channels opposite the cross member 52 (outer side of the bathtub). Each plate 64 is provided with threaded holes 65 through which a threaded adjustment screw 66 is threadedly received. The bottom ends of the adjustment screws 66 are rotatably connected to a support disk 67. The top end of the adjustment screws 66 are provided with a knob or wings 68 for rotating the screws. A pad 69 of water resistant resilient material is secured to the bottom surface of the support disks 67. The support disks 67 are supported on the top edge of the bathtub opposite the wall against which the bathtub is installed. Extra holes 65 allow the adjustment screw to be placed such that the support disk 67 is substantially centered on the top edge of the bathtub wall. Rotation of the adjustment screws 66 causes relative vertical movement between the cross member 53 and the support disks 67 such that when the support disks are supported on the bathtub, the end of the track assembly may be raised or lowered. End caps 55 may also be provided at the ends of the channel members 51 to prevent water from running out the ends of the channels (FIG. 8).

Thus, it can be seen that by turning the adjustment screws 56 and 66, each end of the track assembly 50 can be independently raised or lowered relative to the tub edges to adjust the height of the channels 51 relative to the floor and to level the track assembly or to angle the channels to facilitate drainage. As seen in FIG. 8, a level 70 secured to the side of at least one channel member 51 intermediate its ends contains a bubble 71 within a sight glass 72 which allows precise leveling of the track assembly.

A pair of inverted U-shaped brackets 73 are secured to the underside of the channel members 51 near their outer end which fits over the top edge of the bathtub opposite the wall against which the bathtub is installed. The opposed legs 74 of each bracket 73 are flat rectangular members and are parallel spaced. The bracket legs 74 straddle the wall of the bathtub. The distance between the bracket legs 74 is sufficient to accommodate various widths of bathtub walls with clearance therebetween.

Each bracket leg 74 is provided with threaded holes 75 through which a threaded adjustment screw 76 is threadedly received. The inner facing ends of the adjustment screws 76 are rotatably connected to a clamping disk 77. The outer end of the adjustment screws 76 are provided with a knob or wings. 78 for rotating the screws. A pad 79 of water resistant resilient material is secured to the outer surface of the clamping disks 77. Rotation of the adjustment screws 76 causes relative horizontal movement between the clamping disks 77 and the bracket legs 74 such that when the support strap 60 is supported on the top edge of the bathtub adjacent the wall against which the bathtub is installed, the adjustment screws 76 may be rotated to move the clamping disks 77 inwardly to firmly engage the inner and outer surfaces of the outer wall of the bathtub.

Thus, it can be seen that by positioning the support strap 60 on the top edge of the bathtub adjacent the wall against which the bathtub is installed and turning the adjustment screws 76, the track assembly 50 can be clamped onto bathtubs having various tub widths or distances between the opposed walls of the bathtub.

As best seen in FIGS. 8 and 10, a box-like tapered receptacle 80 is secured to the underside of the cross member 53 intermediate the channels 51 and has a tapered central opening 81 to receive the flat tapered connector member 24 which is hingedly connected to the cross member 22B of the shower-commode chair 10. Holes 82 extend through the cross member 53 and the bottom wall of the receptacle 80 to receive the shaft 83 of a headed lock pin 84. When the connector member 24 is received in the receptacle 80, the shaft 83 of the lock pin 84 is inserted through the holes 82 and 25 to secure the shower-commode chair 10 to the transfer track 50. Thus, the channels 23 of the shower-commode chair 10 are easily and quickly connected to the transfer track 50.

Because of the adjustability of the shower-commode chair 10 and the track 50, the chair height can be adjusted such that the seat cushion is at a convenient height relative to the bed, or other transfer area, so that the non-ambulatory person may slide or transfer easily onto the seat. The seat height should also be sufficient to fit over the toilet bowl of the commode. The track 50 can then be installed on the tub and adjusted in height and leveled such that when the chair is placed adjacent the track, the track channels 51 will be axially aligned with the chair channels 23. The track can then be slightly angled by turning the adjustment screws 56 to slightly lower the end of the track nearest the bathroom wall so that water entering the channels will drain toward that end.

OPERATION

To use the shower-commode chair 10 as a commode chair, one of the arm members 16 is removed and the semi or non-ambulatory person is transferred from the bed, wheelchair, or other chair, to the chair 10 and the arm replaced. The channels 23 may be provided with holes at the outer sides of the wheels through which pins can be inserted to prevent the seat from rolling off the track during the transfer. When the arm members 16 are in place, they prevent the seat 26 from rolling out of the channels 23. The chair can then be rolled into the bathroom and positioned with the legs 13 on each side of the commode to place the chair seat 26 above the toilet bowl of the commode. The shower-commode chair 10 may also be provided with a pair of rails or a platform beneath the seat 26 which would slidably receive and support a removable container or bed pan whereby it would not be necessary to transport the chair to the commode.

With reference to FIGS. 1, 2, and 3, to use the shower-commode chair 10 as a shower chair, one of the arm members 16 is removed and the person is transferred from the bed, wheelchair, or other chair to the chair 10 and the arm is replaced. The arm members 16 prevent the seat 27 from rolling out of the channels 23. The chair can then be rolled into the bathroom and positioned adjacent the bathtub B. The chair 10 is then positioned such that the chair channels 23 are axially aligned with the track channels 51. The flat tapered connector member 24 which is hingedly connected to the cross member 22B of the chair 10 is raised, and the chair is moved toward the track (FIG. 1). When the connector member 24 is received in the receptacle 80, the ends of channels 23 and 51 will be butted together and the lock pin 84 secures the shower-commode chair 10 to the transfer track 50 (FIG. 2).

Usually, once the shower-commode chair has been adjusted to facilitate transfer from a common transfer area (usually the bed), the track channels 51 can be correspondingly adjusted in height so that no further height adjustments are necessary to use the shower-commode chair for toileting or showering.

The arm member 16 on the bathtub side of the chair is removed, and the seat 26 of the shower-commode chair 10 is then capable of being rolled from the chair channels 23 to the track channels 51. Depending upon the occupant's physical abilities, rolling transfer can be accomplished either independently or with assistance. The seated person's legs are lifted one at a time over the bathtub wall as the seat 26 rolls onto the transfer track. The chair 10 can then be disconnected from the track 50 by lifting out the lock pin 84 and moving the chair away from the bathtub (FIG. 3). This will allow easier access by the attendant to the showering person and/or easier and more convenient access to the bathroom facilities by other household members.

The end caps 55 (FIG. 8) may then be installed at the outer ends of the channel members 51 to prevent water from running out the ends of the channels. The seat 26 is then positioned on the tracks at the center of the tub area and the person can then be easily bathed or showered independently or with assistance. The existing shower curtain may be drapped over the shower track channels 51, and inside the outer wall of the tub B to prevent water from splashing outside the tub.

After the bath or shower, the chair 10 is again positioned such that the chair channels 23 are axially aligned with the track channels 51, the connector member 24 is raised and the chair is moved toward the track, and the lock pin 84 is inserted through the holes 82 and 25 to secure the shower-commode chair 10 to the transfer track 50. The seat 26 of the shower-commode chair 10 is then capable of being rolled from track channels 51 back onto the chair channels 23. Rolling transfer can be accomplished either independently or with assistance by lifting the seated person's legs one at a time over the bathtub wall as the seat 26 rolls onto the chair. The chair 10 can then be disconnected from the track 50 by lifting out the lock pin 84 and the arm member 16 replaced. The chair can then be rolled back to the bed, wheelchair, another chair, or other location desired by the seated person for transfer purposes.

It should be understood that the track 50 with the seat 26 movably installed thereon can also be used alone apart from the chair 10 as a bathtub shower accessory. This would allow semi-ambulatory or even ambulatory persons having a physical impairment to use the track and movable seat above the bathtub area in cases where entry into, or standing in the bathtub is either difficult or dangerous. The chair seat may also be locked in a stationary position for access by a standing person by placing pins into the appropriate drain holes at each side of the chair's seat rollers in one of the tracks.

Figure 12:
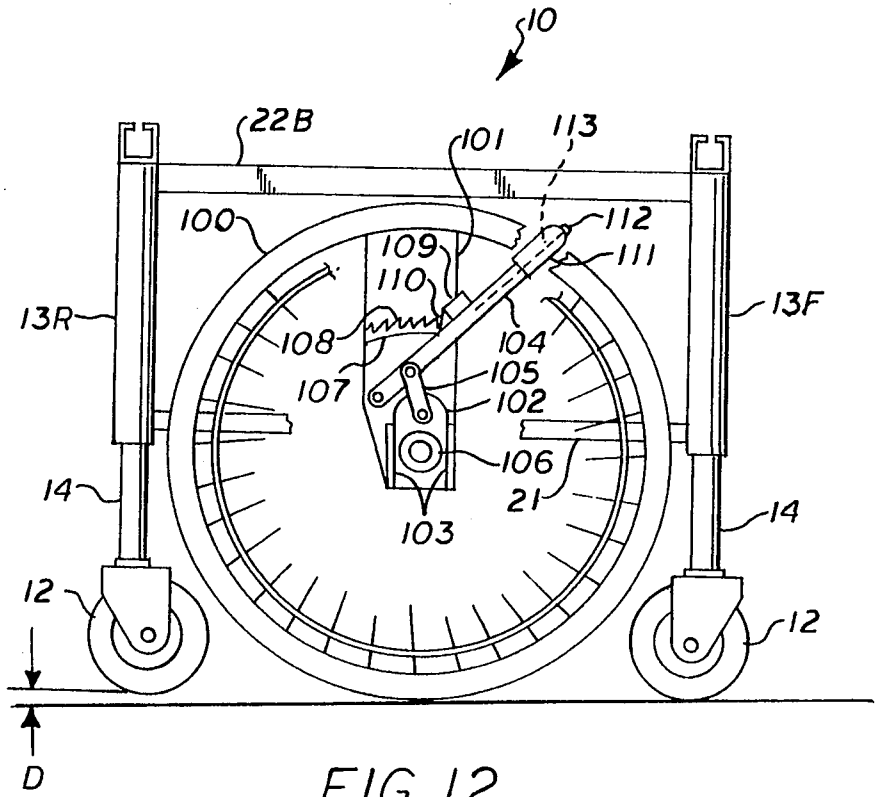
FIGS. 11 and 12 are side elevations of the shower-commode chair provided with propulsion wheels whereby the chair may be used and propelled by the occupant.
Figure 11:
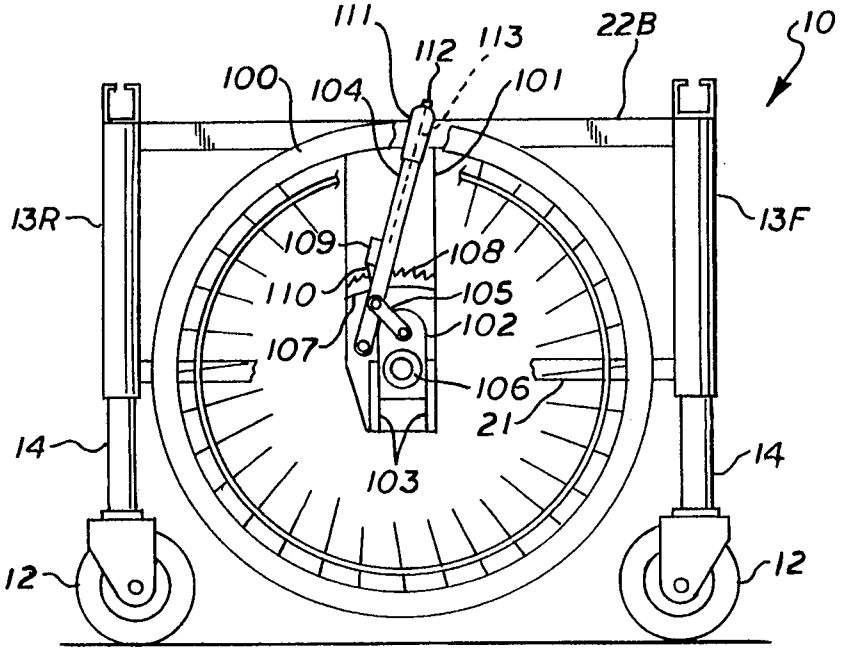

Referring now to FIGS. 11 and 12, when occupant propulsion is desired, the shower-commode chair 10 may be provided with propulsion wheels 100 on each side whereby the chair may be propelled in the manner of a wheelchair. In this configuration, the chair can be used as a comfortable multi-purpose chair capable of omni-directional movement which allows it to be easily maneuvered into small places. In this modification, a wheel support plate 101 is secured to the upper cross members 22B and lower crossmembers 21 which extend from front to rear between the front and rear legs 13F and 13R, respectively, and extends vertically therebetween. The wheel support plate also adds strength to the chair frame.

A hub mounting plate 102 is slidably received within a pair of laterally spaced guide tracks 103 to move vertically relative to the wheel support plate 101. A lever arm 104 is pivotally connected to the wheel support plate 101 at one side of the guide tracks 103. The lever arm 104 is connected to the hub mounting plate 102 by link member 105 which is pivotally pinned at one end to the lever arm 104 and at its other end to the top portion of the hub mounting plate 102. As the lever arm 104 is pushed forward, the hub mounting plate 102 is pushed downward by the link member 105, and when pulled rearward, the hub mounting plate is raised.

The hub 106 of the propulsion wheel 100 is rotatably mounted on the hub mounting plate 102 and carried up and down therewith as the hub mounting plate moves vertically. The axis of the wheel hub 106 is nearer the rear legs 13R than the front legs 13F such that when propulsion wheels 100 are in their downward position (FIG. 12), the rear wheels 13R will be raised a short distance D off the ground, and the weight of the occupant is supported on the propulsion wheels 100 and front wheels 13F and the chair 10 can be propelled and maneuvered in the manner of a conventional wheelchair.

It should be noted in FIGS. 11 and 12, that the diameter of the propulsion wheels 100 are such that they do not interfere with the rolling movement of the seat 26 on the channels 23 of the chair or the tub tracks 51.

An arcuate rack 107 having a toothed upper surface 108 is secured on the wheel support plate 101 above the hub mounting plate 102. A plunger 109 having an outwardly spring biased tongue member 110 is mounted on the lever arm 104 and the outwardly biased tongue 110 is urged normally into engagement in the teeth 108 of the rack 107. A hand grip 111 is mounted on the outer end of the lever arm 104 and has a push button 112 protruding therefrom. The push button 112 is connected to the rear portion of the tongue 110 of the plunger 109 by a push rod and link mechanism 113 which passes through the lever arm 104. As the lever arm 104 is pushed forward, the spring biased plunger tongue 110 ratchets across the toothed surface 108 of the rack 107 and when the pushing force is stopped, the tongue will engage a tooth surface to prevent the lever arm 104 from accidentally pivoting rearward and to releasably lock the hub 106 of propulsion wheel 100 in a selective downward position. When the push button 112 is pressed downward, the tongue 110 is retracted from engagement with the tooth surface of the rack 107 and the lever arm 104 will be caused to pivot rearwardly by the link member 105 being pushed upwardly by the hub mounting plate 102 due to the weight of the occupant.

When using the shower-commode chair modification of FIG. 11, the occupant has the capability of multidirectional movement which is a significant advantage over conventional commode chairs. With the embodiment of FIGS. 11 and 12, the chair occupant can propel themself to the bathroom doorway and, if it is too narrow for the chair to pass through, disengage (raise) the propulsion wheels 100 such that the chair is supported on the four smaller front and rear wheels 12 and then move the chair sideways through the doorway by gripping the door frame and pulling themself in a seated position through the doorway. Once inside the bathroom, the chair occupant can again engage (lower) the propulsion wheels 100 and maneuver themself over the commode for toileting or to the shower track and slide the seat onto the track for showering or bathing. This ability to move the shower-commode chair sideways makes use of the shower-commode chair's smaller dimensions when turned sideways. Sideway passage is the only method by which conventional commode chairs can pass through a standard bathroom doorway, because of their overall design dimensions.

It should also be understood that the shower-commode chair 10 may be used apart from the transfer track 50 by converting it to a general purpose utility chair or to a general purpose wheelchair with accessories described below.

Figure 13:
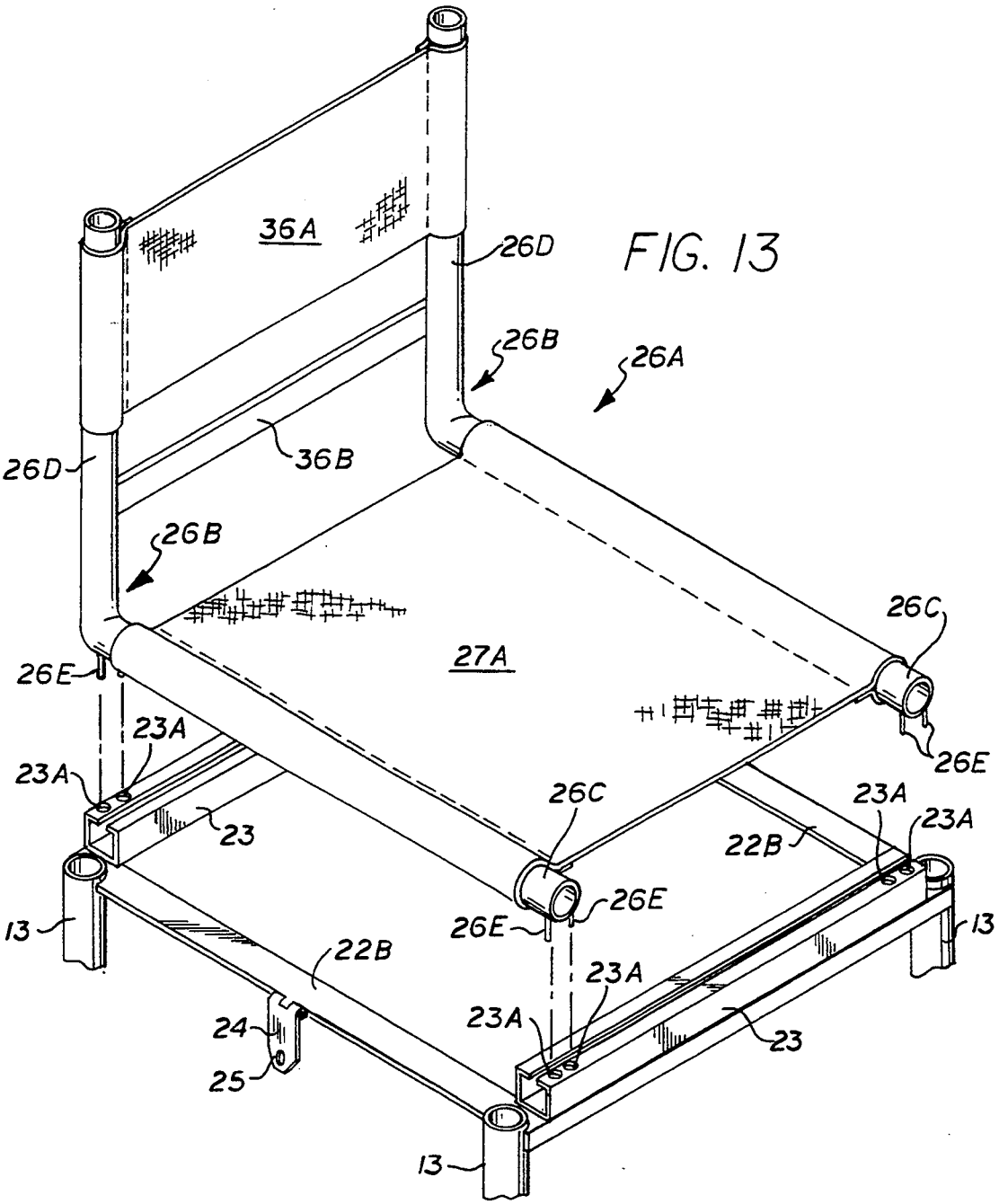
FIG. 13 is an exploded isometric view of a removable replacement seat which may be used as desired.

When not used as a commode chair, the previously described rolling seat 26 having a central aperture is not required and may be removed from the channel members 23. As seen in FIG. 13, a replacement seat 26A may be removably installed on the channel members 23. The replacement seat 26A has a pair of parallel L-shaped side rod members 26B, the horizontal legs 26C of which are spanned by a seat member 27A and the upstanding legs 26D are spanned by a backrest member 36A. A horizontal cross member 36B may also be secured between the upstanding legs 26D. The seat member 27A and backrest 36A may be flexible or rigid. Depending pins 26E are provided at the forward and rearward ends of the horizontal legs 26D and are slidably received in corresponding axially aligned apertures 23A in the top surface of the channel members 23 near their outer ends. It should be understood, that the L-shaped seat members 26B may be hinged or telescopically connected such that the vertical and horizontal members can be folded or taken apart for compact storage and portability.

Figure 14:
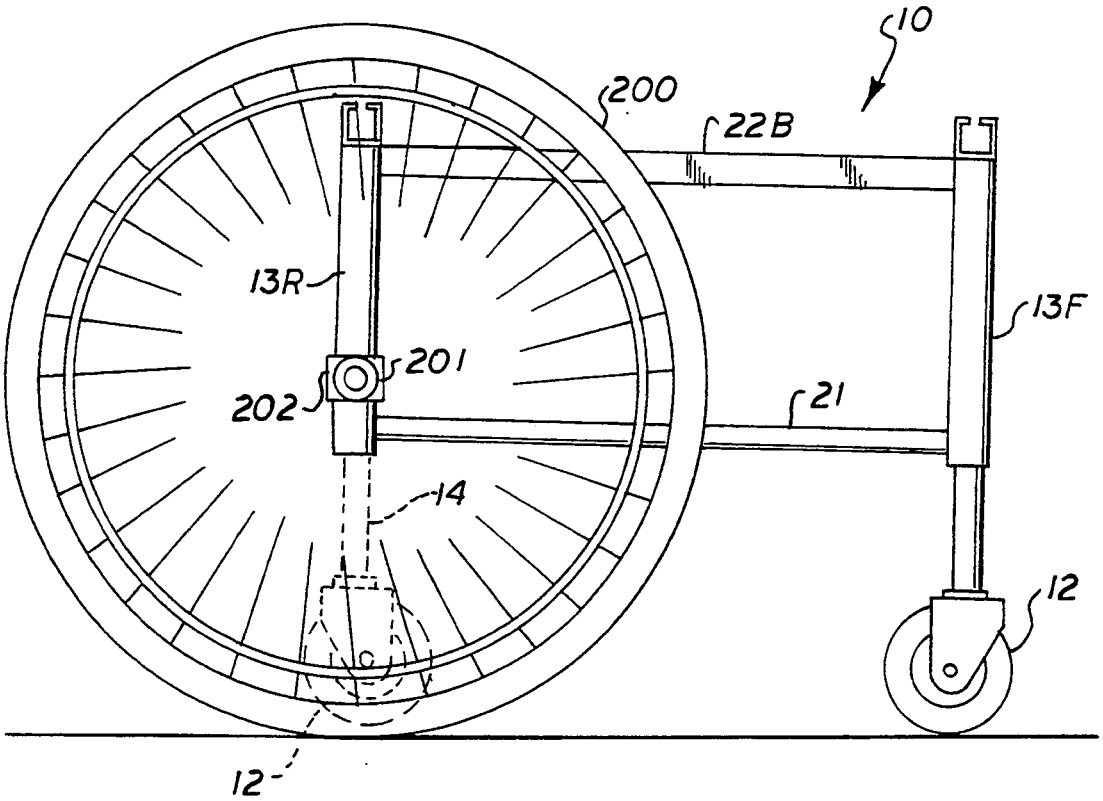
FIG. 14 is a side elevation of the shower-commode chair provided with wheelchair wheels at the rear of the frame whereby the chair may be propelled by the occupant in the manner of a wheelchair.

Referring now to FIG. 14, there is shown another modification of the shower-commode chair 10 with wheelchair wheels 200 on each side at the rear of the frame whereby the chair may be propelled in the manner of a wheelchair. The larger diameter wheels allow the occupant greater propulsion power and speed. In this modification, a hub mounting plate 201 is secured to the rear legs 13R. The hub 202 of the wheelchair wheel 200 is rotatably mounted on the hub mounting plate 201 by a conventional quick release coupling. The axis of the wheel hub 202 is mounted such that the rear wheels 13R will be raised a distance off the ground, or can be completely removed, whereby the occupant is supported on the wheelchair wheels 200 and front wheels 13F and the chair 10 can be propelled and maneuvered in the manner of a conventional wheelchair.

Figure 15:
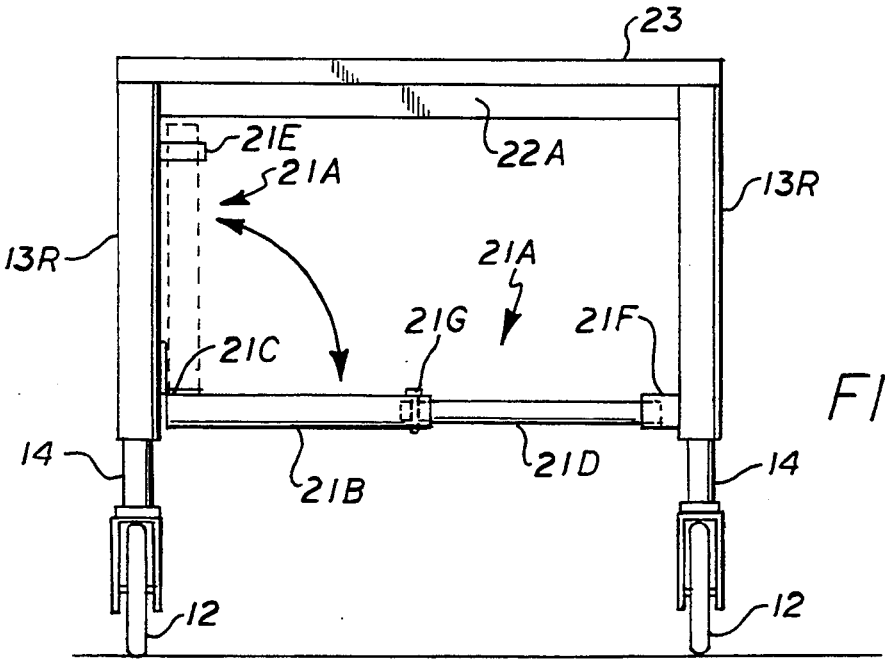
FIG. 15 is a rear elevation of the wheelchair conversion showing a telescoping rear horizontal cross member.

As previously described with reference to FIGS. 1 and 2, the chair has lower cross members 21 which extend horizontally between the lower portion of the legs 13 on the sides and front, leaving the rear of the chair frame open so that it can be positioned to surround the toilet bowl. As seen from the rear in FIG. 15, the shower-commode chair 10 may be provided with a fourth cross member 21A to provide additional strength when the chair is converted to a general purpose wheelchair. The cross member 21A has an outer tubular member 21B hingedly connected to one of the rear legs 13R by hinge 21C and has an inner tubular member 21D telescopically received therein. A clamp 21E is secured on the leg 13R above the hinge 21C and a short collar 21F is secured on the opposed rear leg to slidably receive the outer end of the inner tubular member 21D.

The fourth cross member 21A pivots about its hinge connection between a non-use position held by the clamp 21E parallel to the leg 13R on which it is hinged and an in-use position wherein the inner tubular member 21D slides out to be received in the collar 21F. The fourth cross member 21A is held in the extended position by a pin 21G installed through aligned holes in the tubular members 21B and 21D.

The wheels of the previously described embodiments may be provided with a conventional brake system and conventional pivotal footrests may be removably installed on the front legs of the frame.

The vertical leg and frame components of the shower-commode chair may also be hingedly connected such that the chair can be folded. For example, the upper cross member 22A and C-shaped channel member 23 at the rear of the chair 10 may be removably connected to the rear vertical legs 13 and the upper and lower cross members 22B and 21 which extend between the front and rear legs may be connected to the front legs with hinge connections. In this manner, the seat 26 and the upper cross member 22A and C-shaped channel member 23 at the rear of the chair 10 can be removed, and the upper and lower cross members 22B and 21 which extend between the front and rear legs can be rotated about the front legs, such that the frame can be folded for compact storage and easily transported in a small space.

While this invention has been described fully and completely with special emphasis upon a preferred embodiment, it should be understood that within the scope of the appended claims the invention may be practiced otherwise than as specifically described herein.

I claim:

1. A shower-commode chair and bathtub transfer track comprising;

a chair having a frame with four vertical legs supported on wheels and a pair of horizontal channel members mounted at the top thereof in parallel spaced relation extending from side to side, a seat movably supported on said chair frame horizontal channel members by roller connected to the underside of said seat and selectively movable longitudinally within said chair frame channel members relative thereto, bathtub transfer track means having a pair of elongate channel members secured in parallel spaced relation supported on the top surfaces of laterally opposed side walls of a conventional bathtub to transversely span the open tub area of the conventional bathtub for receiving said rollers and movably supporting said seat, releasable connector means on said chair frame for releasably coupling said chair frame horizontal channel members with said bathtub transfer track means elongate channel members, height adjustment means on said chair frame to adjust the height of said seat relative to the floor for varying the height of a seated individual to facilitate transfer to and from various bed heights, commode height, and bathtub heights, and height and level adjustment means on said bathtub transfer track means to adjust the height of said transfer track channel members relative to the height of said chair seat to facilitate receipt of said rollers and to adjust said transfer track channel members angularly relative to a horizontal plane to facilitate drainage of water therefrom, whereby a non-ambulatory person may be transferred onto said chair seat and transported on said chair to a position adjacent said bathtub transfer track means and thereafter said chair frame releasably coupled to said transfer track means, and said seat with the person seated thereon transferred from said chair frame onto said bathtub transfer track means and supported over the open tub area of the conventional bathtub in a seated position without being lifted from said seat.

2. A shower-commode chair and bathtub transfer track according to claim 1 including arm members removably connected to said chair frame and independently selectively removable therefrom, said arm members retaining said seat on said chair frame when connected thereon and allowing movement of said seat when removed therefrom.

3. A shower-commode chair and bathtub transfer track according to claim 1 wherein said seat has a flat platform with a central aperture corresponding generally to the size and configuration of the toilet seat of a conventional commode, and said chair frame vertical legs spaced apart a sufficient distance to be received on each side of the toilet bowl of the conventional commode with said seat central aperture positioned above the toilet bowl of the conventional commode.

4. A shower-commode chair and bathtub transfer track according to claim 3 including a water resistant resilient cushion partially encircling said seat central aperture.

5. A shower-commode chair and bathtub transfer track according to claim 1 including a backrest member removably connected to said seat and selectively removable therefrom, said backrest member being movable with said seat when connected thereto.

6. A shower-commode chair and bathtub transfer track according to claim 5 including a seat belt member connected to said backrest member for maintaining the torso of a person seated on said seat in an upright position.

7. A shower-commode chair and bathtub transfer track according to claim 1 including width adjustment means on said bathtub transfer track means for adjusting said bathtub transfer track means to be supported on the top surfaces of laterally opposed side walls of conventional bathtubs to transversely span the open tub area of conventional bathtubs of various widths.

8. A shower-commode chair and bathtub transfer track according to claim 1 including resilient pad means at each end of said bathtub transfer track means for frictionally engaging the top surfaces of the laterally opposed side walls of the bathtub on which said bathtub transfer track means is supported.

9. A shower-commode chair and bathtub transfer track according to claim 1 wherein said chair frame horizontal channel members and said bathtub track transfer means channel members are hollow rectangular members having a generally square transverse cross section with a longitudinal slot extending from end to end.

* * * * *